US007823572B2

(12) United States Patent
Anderson

(10) Patent No.: US 7,823,572 B2
(45) Date of Patent: Nov. 2, 2010

(54) CROSSBOW HAVING ELONGATED DRAW LENGTH

(76) Inventor: Jeffrey R. Anderson, 595 Willow Rd., Wauconda, IL (US) 60084

( * ) Notice: Subject to any disclaimer, the term of this patent is extended or adjusted under 35 U.S.C. 154(b) by 488 days.

(21) Appl. No.: 11/975,769

(22) Filed: Oct. 22, 2007

(65) Prior Publication Data

US 2009/0101126 A1 Apr. 23, 2009

(51) Int. Cl.
*F41B 5/12* (2006.01)

(52) U.S. Cl. ..... 124/25

(58) Field of Classification Search ..... 124/25, 124/25.6

See application file for complete search history.

(56) References Cited

U.S. PATENT DOCUMENTS

| | | | | | |
|---|---|---|---|---|---|
| 4,294,222 | A | * | 10/1981 | Pelsue | 124/25 |
| 4,829,974 | A | | 5/1989 | Anderson | 124/24 R |
| 4,947,822 | A | * | 8/1990 | Jones et al. | 124/41.1 |
| 4,958,617 | A | | 9/1990 | Anderson | 124/24.1 |
| 5,054,463 | A | * | 10/1991 | Colley et al. | 124/25.6 |
| 5,119,797 | A | | 6/1992 | Anderson | 124/25 |
| 5,263,465 | A | | 11/1993 | Anderson | 124/24.1 |
| 5,678,528 | A | * | 10/1997 | Hadley | 124/25 |
| 6,142,123 | A | | 11/2000 | Anderson | 124/25.6 |
| 6,715,481 | B1 | | 4/2004 | Anderson | 124/88 |
| 6,752,136 | B1 | | 6/2004 | Anderson | 124/24.1 |
| 7,066,166 | B2 | * | 6/2006 | Crites et al. | 124/25 |
| 7,578,289 | B2 | * | 8/2009 | Norkus | 124/25.6 |

* cited by examiner

*Primary Examiner*—John Ricci
(74) *Attorney, Agent, or Firm*—Rolland R Hackbart

(57) ABSTRACT

A novel embodiment of a crossbow (10) includes an elongated draw length and a rifle-type stock (134) with a tubular barrel (106) designed to shoot standard three-fletch arrows (120) with a three-blade hunting tip. When the main string (105) of the crossbow (10) is fully drawn and cocked, the string compression levers (110) that are pivoted so that the pulleys (113) on levers (110) engage the string (105) and deflect the string (105) toward the barrel (106) until the string compression levers 110 rest against the side of the barrel (106). The crossbow (10) has a draw length significantly longer than the draw length of a conventional crossbow of the same overall size, thereby providing a larger power stroke with less draw weight. In the other embodiments, the crossbow (20, 30) may include a barrel (106) with rectangular cross section for shooting shot filled sabots for bird hunting, small game hunting or trap shooting or a barrel (106) with a circular cross section for shooting paint-ball filled sabots for paint ball games.

23 Claims, 11 Drawing Sheets

10

CROSSBOW HAVING ELONGATED DRAW LENGTH

TECHNICAL FIELD

The present invention relates generally to the field of archery bows, and more particularly to a crossbow having an elongated draw length and longer power stroke for shooting arrows or sabots containing shot pellets or other projectiles.

BACKGROUND

A conventional crossbow with a tubular barrel is illustrated in FIG. 1 of my U.S. Pat. No. 5,119,797. The string release of conventional crossbows must be located a sufficient distance in front of the butt end of the crossbow stock so that the string when cocked is in front of the shooter's face when aiming and shooting. Thus, the draw length of a conventional crossbow is limited to the distance from the riser to forward located string release. For a typical draw length of 13 to 17 inches (also referred to as the power stroke), the draw weight of a conventional crossbow must be around 150 to 225 pounds in order propel a 20 inch arrow of appropriate weight at speeds between 250 to 350 feet per second. Making a crossbow longer to get a power stroke longer than 17 inches is impractical since it becomes heavy, bulky and unwieldy. Accordingly, there is a need for an improved crossbow having an elongated draw length that is significantly longer than the draw length of conventional crossbows of substantially the same overall size, thereby providing a longer power stroke with less draw weight to achieve similar arrow speeds with similar kinetic energies.

DETAILED DESCRIPTION OF THE DRAWINGS

Figure 1:
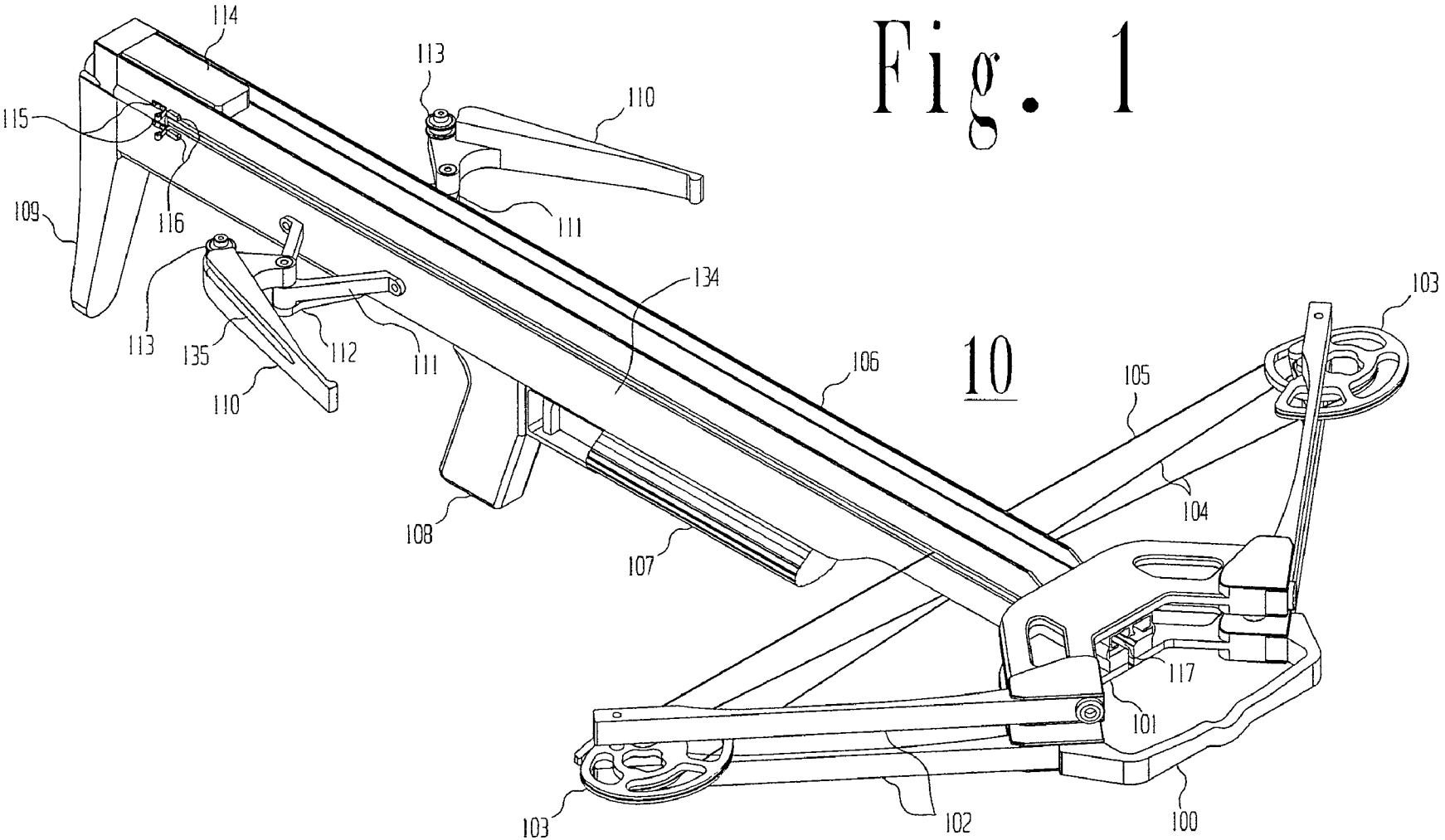
FIG. 1 is a right-side view of a crossbow with an elongated draw length and a tubular barrel designed to shoot standard three-fletch arrows with a three-blade hunting tip, illustrative of an embodiment of my invention.

A crossbow illustrative of my invention comprises: first and second limbs, each having first and second ends; a riser to receive the first end of the first and second limbs; a first cam with an axle to couple to the second end of the first limb; a second cam with an axle to couple to the second end of the second limb; a string extending between the first cam and the second cam; a string release adapted to hold the string when the crossbow is cocked; a stock having a bore end and butt end, the stock including a pistol grip, a trigger coupled to the string release, and a barrel extending between the bore end and a butt end of the stock, the bore end of the stock coupled to the riser, the string release disposed near the butt end of the stock, and the barrel adapted to receive one of an arrow or sabot; and first and second levers each coupled to the stock near the butt end and adapted to deflect the string toward the stock when rotated after the crossbow string is cocked and held by the string release.

Referring now to FIGS. 1 through 4, there is illustrated a right-side view of a crossbow 10 with an elongated draw length includes a riser 101, stirrup 100, first and second split limbs 102 each having a first end coupled to the riser 101, right and left eccentric cams 103 with axles attached to a second ends of the first and second split limbs 102, main string 105 and harness 104 coupled to right and left eccentric cams 103, and a rifle-type stock 134 with a tubular barrel or arrow rest assembly 106 extending between a bore end and butt end of the stock 134. The bore end of the stock 134 and the tubular barrel 106 are attached between the top portion and bottom portion of the riser 101. The rifle-type stock 134 and the tubular barrel 106 may be one extruded piece or separate pieces bolted or otherwise attached to one another. A forearm 107, a pistol grip 108 with trigger, and a shoulder rest 109 are also bolted or otherwise attached to the rifle-type stock 134. The tubular barrel 106 is designed to shoot standard three-fletch arrows 120 with a three-blade hunting tip (see FIG. 4). Two string compression levers 110 shown in the open position are disposed on the stock 134 near the butt end of the stock 134. The tubular barrel 106 is comprised of an elongated track with a slot for the string 105 that extends from the bore end 117 to the butt end of the stock 134. A conventional string release mechanism 114 is disposed in the barrel 106 near the butt end of the stock 134 and is coupled to the trigger disposed in grip 108. The tubular barrel 106 is similar to the arrow rest assembly illustrated and described in my U.S. Pat. Nos. 5,119,797, 6,142,133, 6,752,136 and 6,752,136, incorporated herein in their entirety by reference. The string release mechanism 114 can be any conventional string release used in crossbows such as, for example, the string release mechanism illustrated and described in my U.S. Pat. No. 5,119,797.

Figure 2:
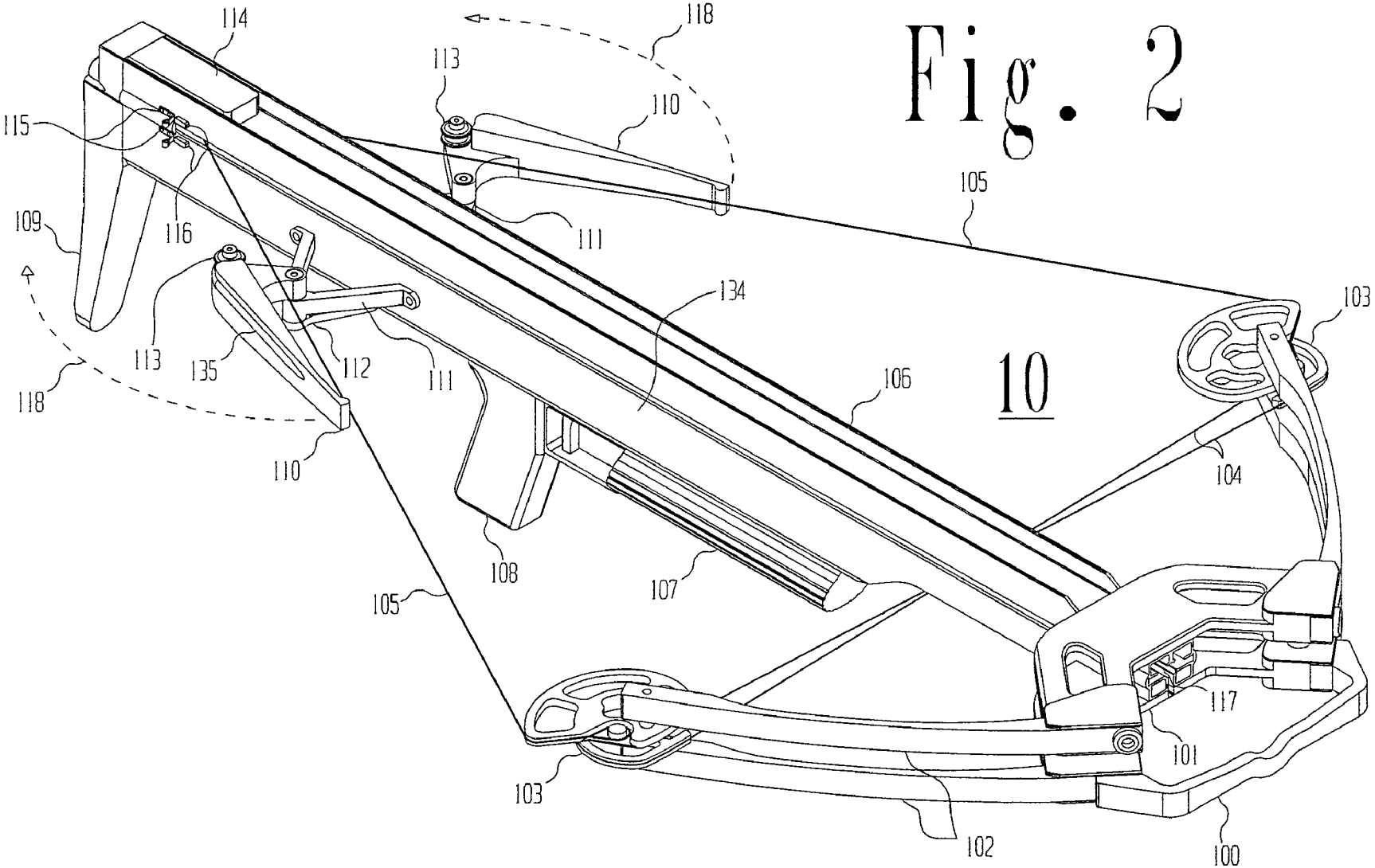
FIG. 2 is a right-side view of the crossbow in FIG. 1, showing the string in cocked position and the string compression levers in the open position.

Referring now to FIG. 2, there is illustrated a right-side view of the crossbow 10 in FIG. 1, showing the string 105 in cocked position and the string compression levers 110 in the open position. In order to cock the crossbow, a shooter places it against the ground and puts his foot within the stirrup 100. The shooter then draws the string 105 against the force of the crossbow limbs 102 storing energy in the crossbow limbs 102. When the string 105 is fully drawn, it is held in position by the string release mechanism 114. According to a novel feature of my invention, the string compression levers 110 are now pivoted along respective paths 118 with pulleys 113 rotatably engaging the string 105 and deflecting the string 105 toward the barrel 106 until the string compression levers 110 rest against the side of the barrel 106 where they engage bumpers 116 (see FIG. 5). The string compression levers 110 have cut outs or grooves 135 that substantially enclose but do not touch the string 105 as levers 110 are pivoted. Since the string 105 is substantially enclosed by cut outs or grooves 135 in levers 110, grooves 135 keep the string 105 from hitting the shooter in the face on release of an arrow 120 and in the unlikely event that the string 105 should break or otherwise separate from the cams 103. When in the closed position against bumpers 116, string compression levers 110 are held in place largely by the pressure of the cocked string 105. To insure that string compression levers 110 do not open or rattle when the string 105 is released, retaining springs 115 (see FIG. 5) assert a spring force against the end or tip of compression levels 110 when in the closed position against bumpers 116.

Figure 3:
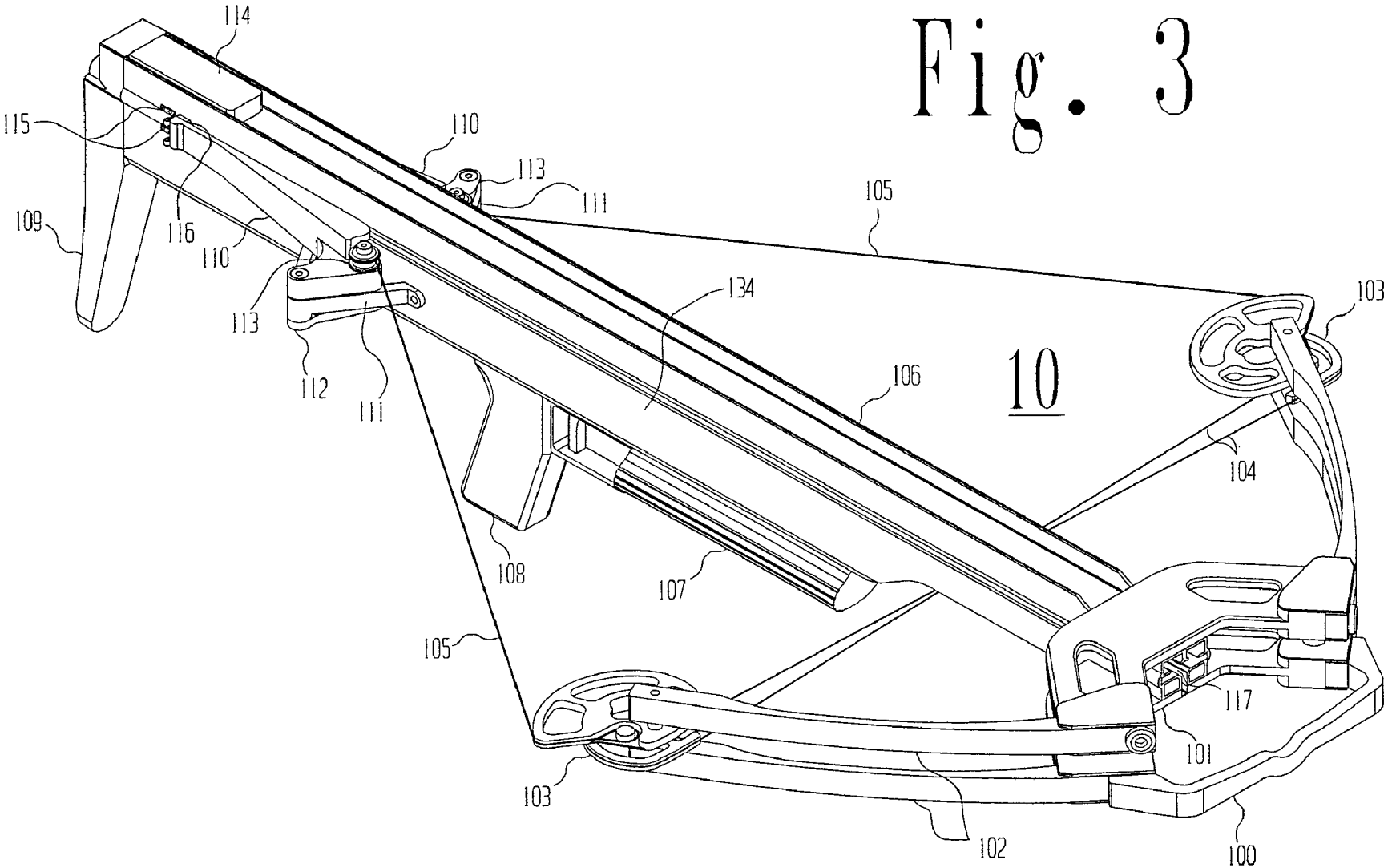
FIG. 3 is a right-side view of the crossbow in FIG. 1, showing the string in cocked position and the string compression levers in the closed position.

Referring now to FIG. 3, there is illustrated a right-side view of the crossbow 10 in FIG. 1, showing the string 105 in cocked position and the string compression levers 110 in the closed position. Once cocked as illustrated in FIG. 3, a standard three-fletch arrow 120 with a three-blade hunting tip (also referred to as a bolt) (see FIG. 4) may be place by a shooter in the barrel 106 of the crossbow and slides down the barrel 106 and engages the cocked string 105 which is held in place by the string release mechanism 114. The arrow 120 may be held in place in the barrel 106 by a spring disposed on the top of the barrel 106 as illustrated and described in my U.S. Pat. Nos. 6,142,133 and 6,752,136. When the shooter pulls or actuates the trigger 108, the string 105 is released by the string release mechanism 114 and the energy stored in the bow limbs 102 propels the arrow 120 from the crossbow 10.

Figure 4:
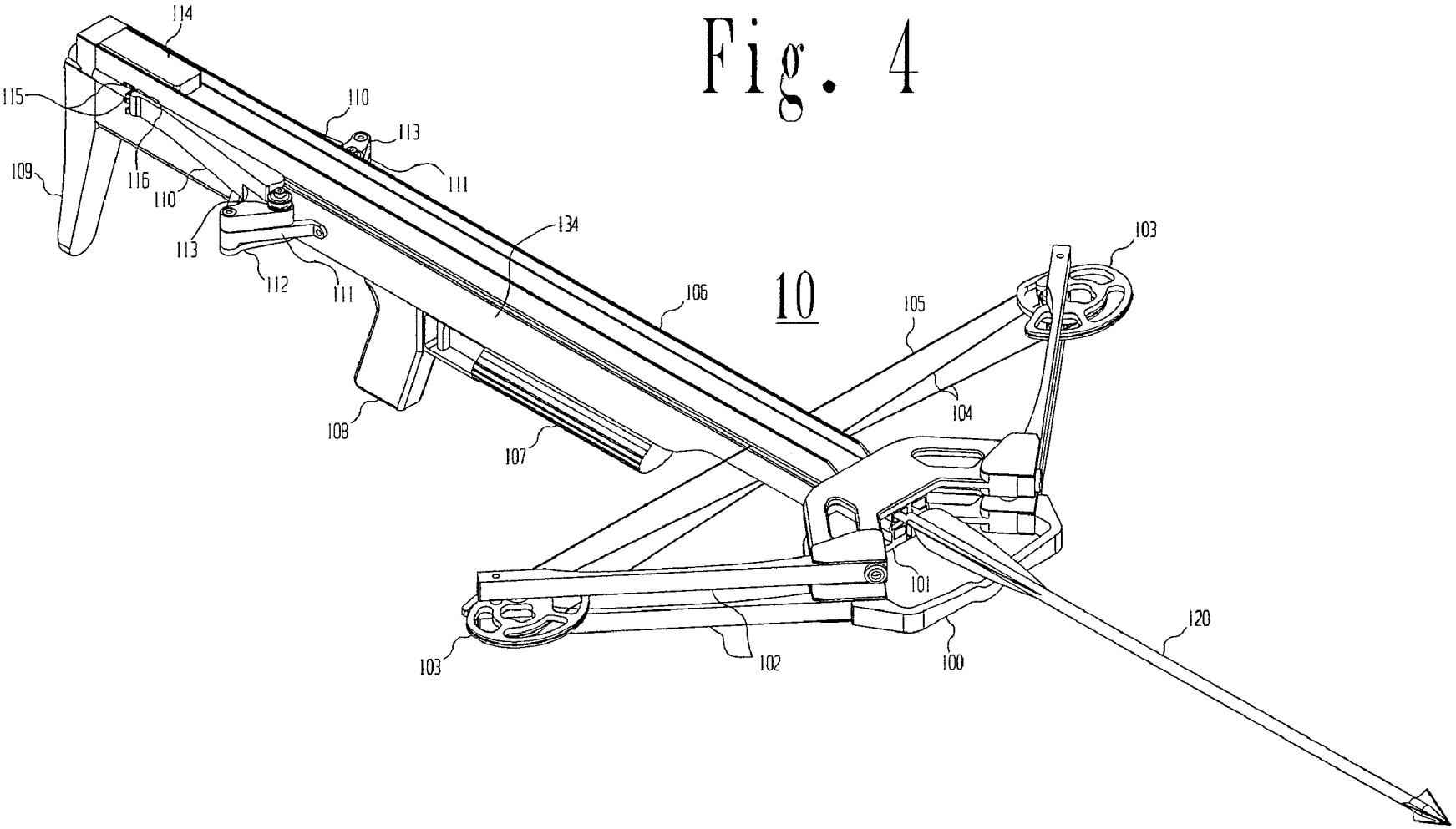
FIG. 4 is a right-side view of the crossbow in FIG. 1, where the string has been released and the standard arrow is being projected from the tubular arrow rest.

Referring now to FIG. 4, there is illustrated a right-side view of the crossbow 10 in FIG. 1, where the string 105 has been released and the arrow 120 is being projected from the bore end 117 (see FIG. 3) of the barrel 106. According to a novel feature of my invention, the string 105 has a power stroke that extends substantially from the at-rest position of the string 105 in FIG. 1 to the butt end of the stock 134 in the cocked position in FIG. 3. By using my invention, a power stroke of around 23 inches or longer can be achieved with an embodiment of the crossbow 10 in FIG. 1 that has a stock 134 that has a length of around 31 inches from the bore 117 (see FIG. 3) to the shoulder rest 109. For example, the crossbow 10 in FIG. 1 with a 23 inch power stroke need only have a draw weight which is approximately one half the draw weight of conventional crossbows to shoot a 20-inch, 400 grain arrow at approximately the same speed that a conventional crossbow with a 16 inch power stroke and draw weight of around 200 pounds would shoot such an arrow. As a result, the crossbow 10 in FIG. 1 is much easier to cock and much safer to operate than conventional crossbows because of the reduced poundage required to get equal performance.

Figure 5:
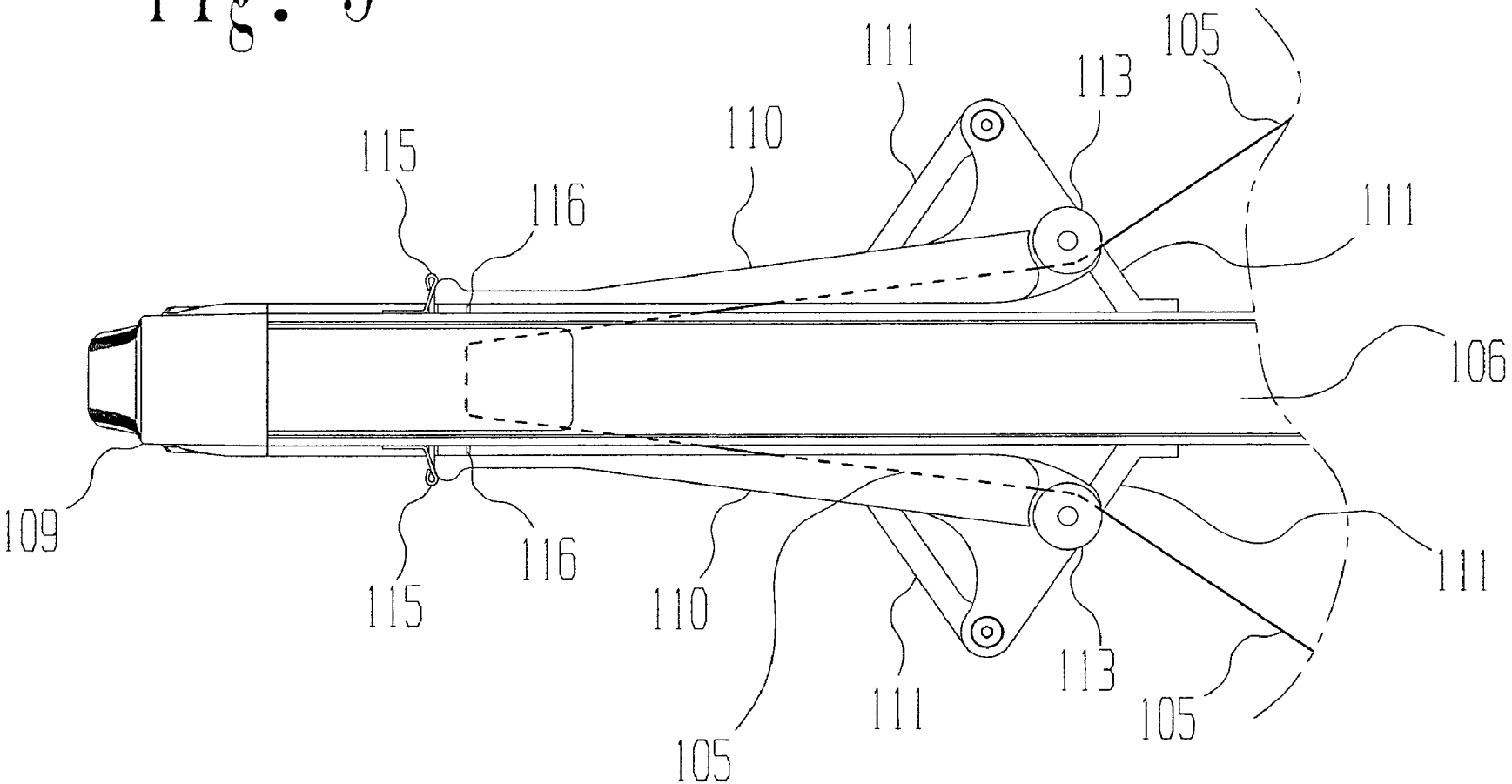
FIG. 5 is a partial top view of the stock end of the crossbow in FIG. 3, showing the string in cocked position and illustrating the string compression levers in the closed position.

Referring now to FIG. 5, there is illustrated a partial top view of the butt end of the crossbow 10 in FIG. 3, showing the string 105 in cocked position and illustrating the string compression levers 110 in the closed position. Spring compression levers 110 are L-shaped and mounted at one end to bracket 111. The bracket supports 112 (see FIG. 4 and FIG. 10) provide further support for corresponding brackets 111 and spring compression levers 110. Spring compression levers 110 each include a pulley 113 with an axle that rotatably engages the string 105 when pivoted along path 118 in FIG. 2 to the closed position. Each spring compression lever 110 includes a cut out or groove 135 (see FIGS. 1 and 2) that substantially encloses and allows the string 105 shown in dashed lines to pass freely through when levers 110 are closed. When levers 110 are in the closed position, cut outs or grooves 135 in levers 110 substantially enclose and keep the string 105 from hitting the shooter in the face on release of an arrow 120 (see FIG. 4) and in the unlikely event that the string should break or otherwise separate from the cams 103. The L-shape of the spring compression levers 110 is at an angle of less than ninety degrees so that they are largely held in place by the pressure of the cocked string 105 when pivoted fully closed. In the closed position illustrated in FIG. 3, spring compression levers engage bumpers 116 and are held against the bumpers 116 so as not to rattle when shooting an arrow 120 by a spring force asserted against the ends or tips of spring release levers 110 by retaining springs 115.

Figure 6:
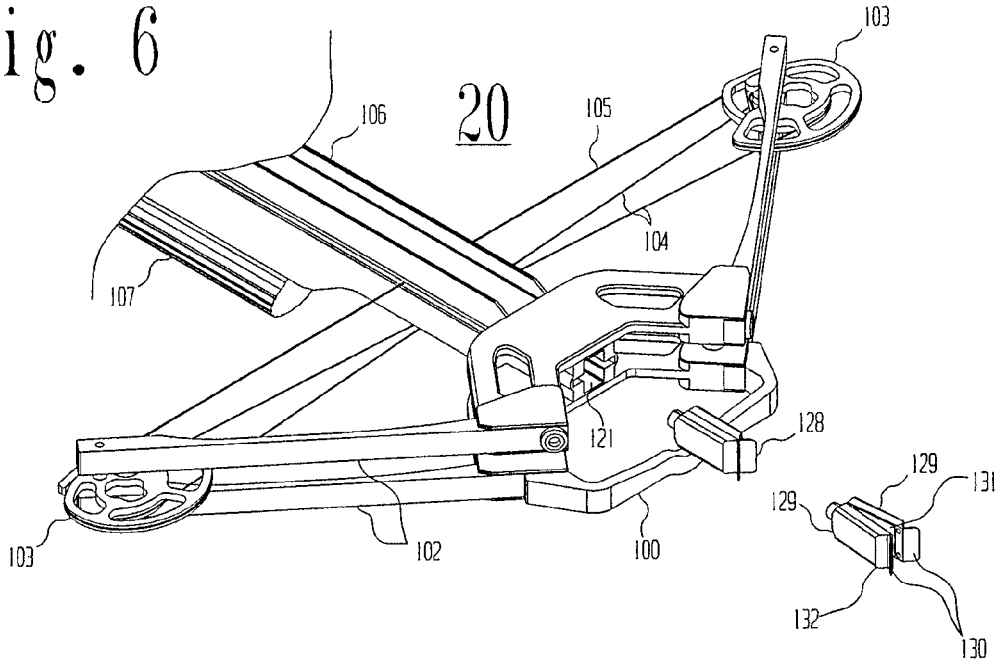
FIG. 6 is a partial right-side view of the bore end of crossbow with an elongated draw length and a tubular barrel having a rectangular cross section for shooting shot-filled sabots having a rectangular cross section, illustrative of another embodiment of my invention.

Referring now to FIG. 6, there is illustrated a partial right-side view of the bore end of crossbow 20 with an elongated draw length and a tubular barrel 106 having a rectangular cross section for shooting a shot-filled sabot 128 having a rectangular cross section, illustrative of another embodiment of my invention. Components of the crossbow 20 in FIG. 6 that are the same as corresponding components of the crossbow 10 in FIG. 1 have been given the same references numbers. Since sabot 128 has a rectangular cross section that corresponds to the rectangular shape of the bore 121 of barrel 106, sabot 128 will always be oriented properly when loaded. The preferred orientation of sabot 128 is that the center line between the two halves 129 is perpendicular to the plane of the riser 101 and limbs 102. This preferred orientation facilitates separation of the two halves 129 of the sabot 128 when it is shot. As illustrated by the sabot 128 being shot from the crossbow in FIG. 6, sabot halves 129 have beveled front surfaces 130 that are urged open by air pressure exposing a hollow compartment that holds any suitable size of lead, steel or other metal shot or other suitably sized projectiles. The sabot 128 is similar to the rectangular sabot illustrated and described in my aforementioned U.S. Pat. No. 6,752,136.

Figure 7:
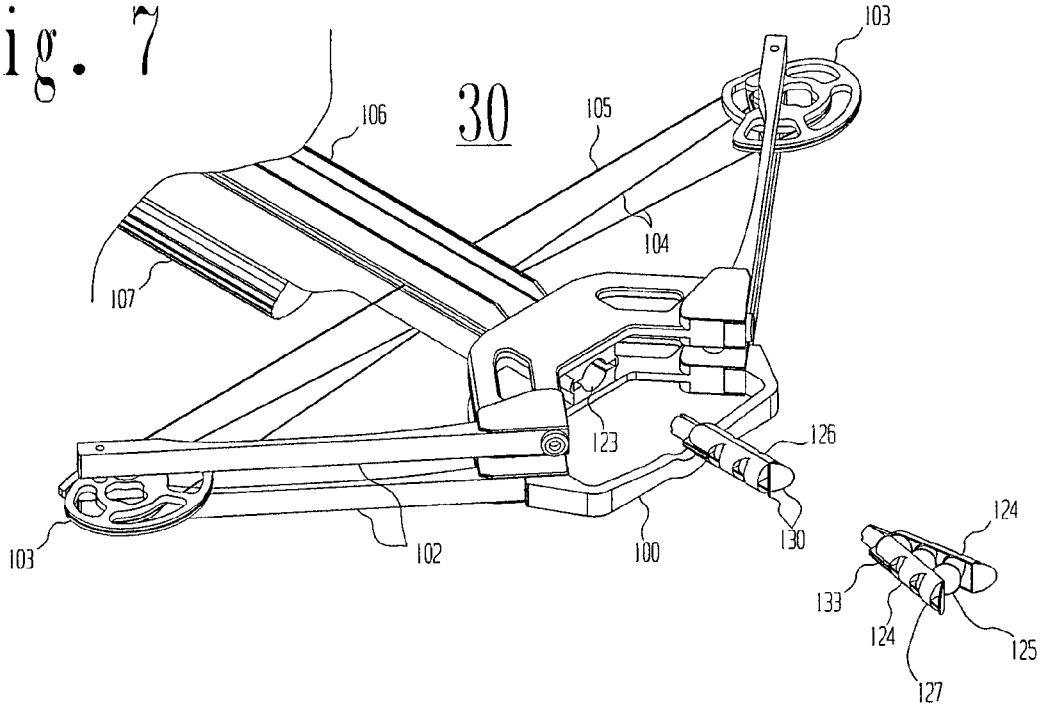
FIG. 7 is a partial right-side view of the bore end of crossbow with an elongated draw length and a tubular barrel having a circular cross section for shooting paint-ball-filled sabots having a circular cross section, illustrative of another embodiment of my invention.

Referring now to FIG. 7, there is illustrated a partial right-side view of the bore end of crossbow 30 with an elongated draw length and a tubular barrel 106 having a circular cross section for shooting a paint-ball-filled sabot 126 having a circular cross section, illustrative of another embodiment of my invention. Components of the crossbow 30 in FIG. 7 that are the same as corresponding components of the crossbow 10 in FIG. 1 have been given the same references numbers. Sabot 126 have a rib 133 along each side of sabot halves 124 to insure that it will always be oriented properly when loaded into the corresponding circular-shaped bore 123 of barrel 106. As illustrated by the sabot 126 being shot from the crossbow in FIG. 7, sabot halves 124 have beveled front surfaces 130 that are urged open by air pressure exposing a hollow compartment that holds several suitably sized paint balls. The sabot 126 is similar to the circular sabot illustrated and described in my aforementioned U.S. Pat. No. 6,752,136.

Figure 8:
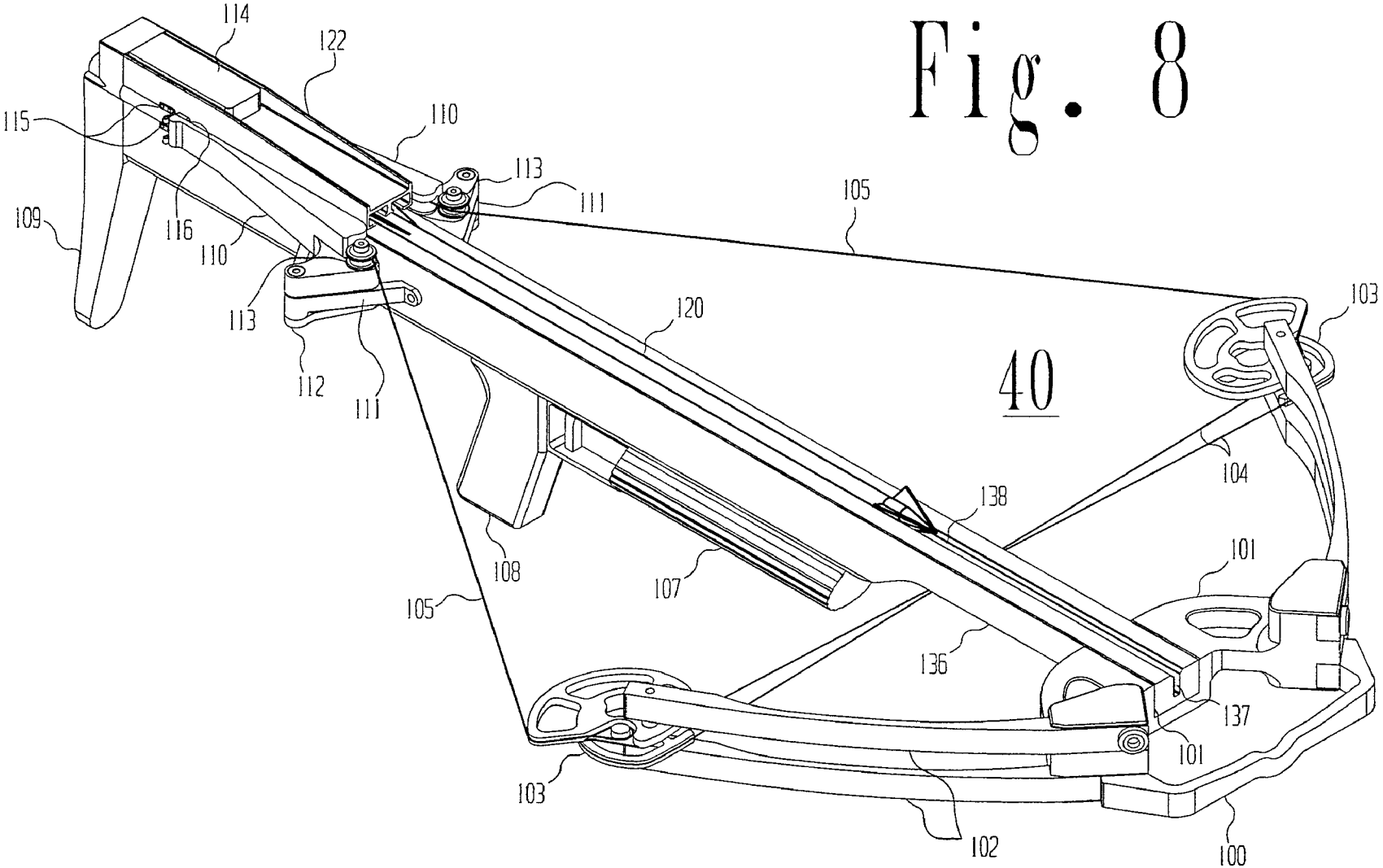
FIG. 8 is a right-side view of a crossbow with an elongated draw length and an arrow rest designed to shoot standard three-fletch arrows with a three-blade hunting tip, illustrative of another embodiment of my invention.

Referring now to FIG. 8, there is illustrated a right-side view of a crossbow 40 with an elongated draw length and a slotted arrow rest 138 for shooting standard three-fletch arrows 120 with a three-blade hunting tip, illustrative of another embodiment of my invention. Components of the crossbow 40 in FIG. 8 that are the same as corresponding components of the crossbow 10 in FIG. 1 have been given the same references numbers. The rifle-type stock 136 has a U-shaped bore 137 forming an arrow rest 138 with a slot similar to that of conventional crossbows with rifle-type stocks. The crossbow 40 is shown in FIG. 8 with the string 105 in cocked position and the string compression levers 110 in the closed position. An arrow 120 has been loaded onto the arrow rest 138 with one blade of the three-blade hunting tip extending into the slot of the arrow rest 138 and the knock end of the arrow 120 extending into the safety guard cover 122 to engage the string 105 held by the string release. Safety guard cover 122 is a cantilever cover that extends from the butt end of the stock 134 over the string 105 and a portion of the arrow 120 that is near the face of the shooter, but can extend further toward the bore end of stock 136 in other embodiments of crossbow 40. Safety guard cover 122 protects the face of the shooter in the unlikely event that the arrow 120 breaks during shooting.

Figure 9:
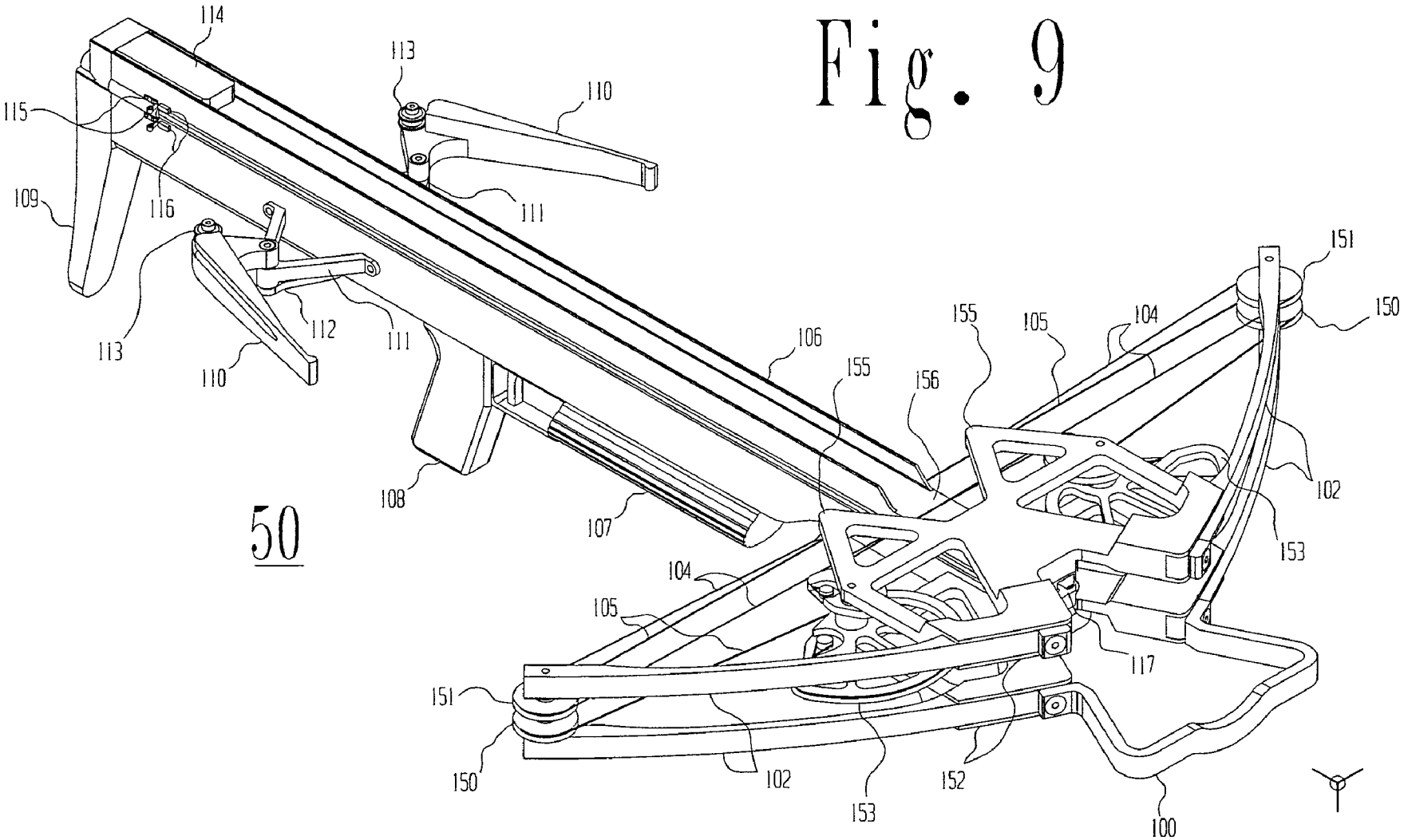
FIG. 9 is a right-side view of a crossbow with an elongated draw length, cams mounted on the riser, dual pulleys attached to the end of each of the split limbs, and a tubular barrel designed to shoot standard three-fetch arrows with a three-blade hunting tip, illustrative of another embodiment of my invention.
Figure 10:
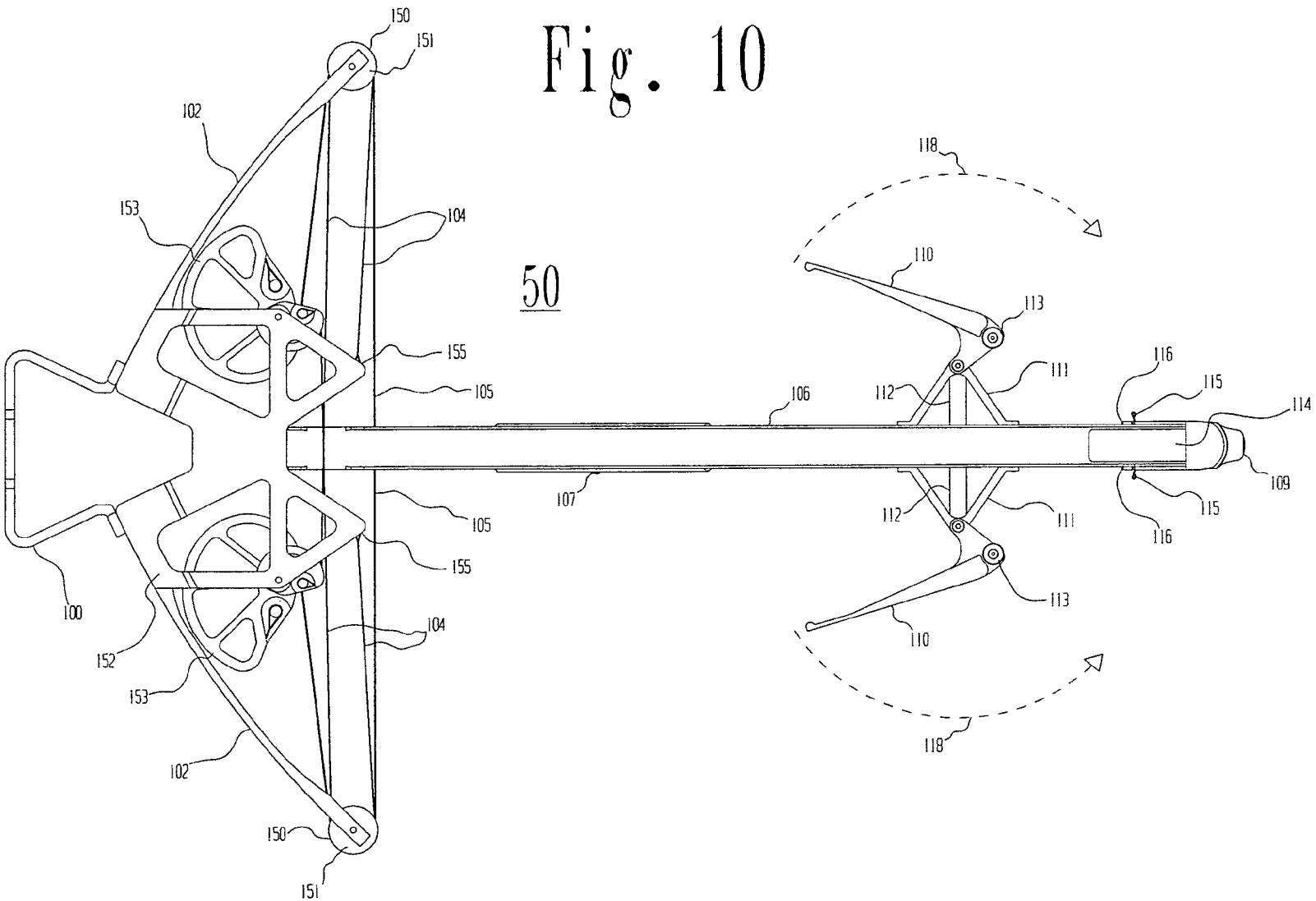
FIG. 10 is a top view of the crossbow in FIG. 9 showing the string at rest and the string compression levers in the open position.
Figure 11:
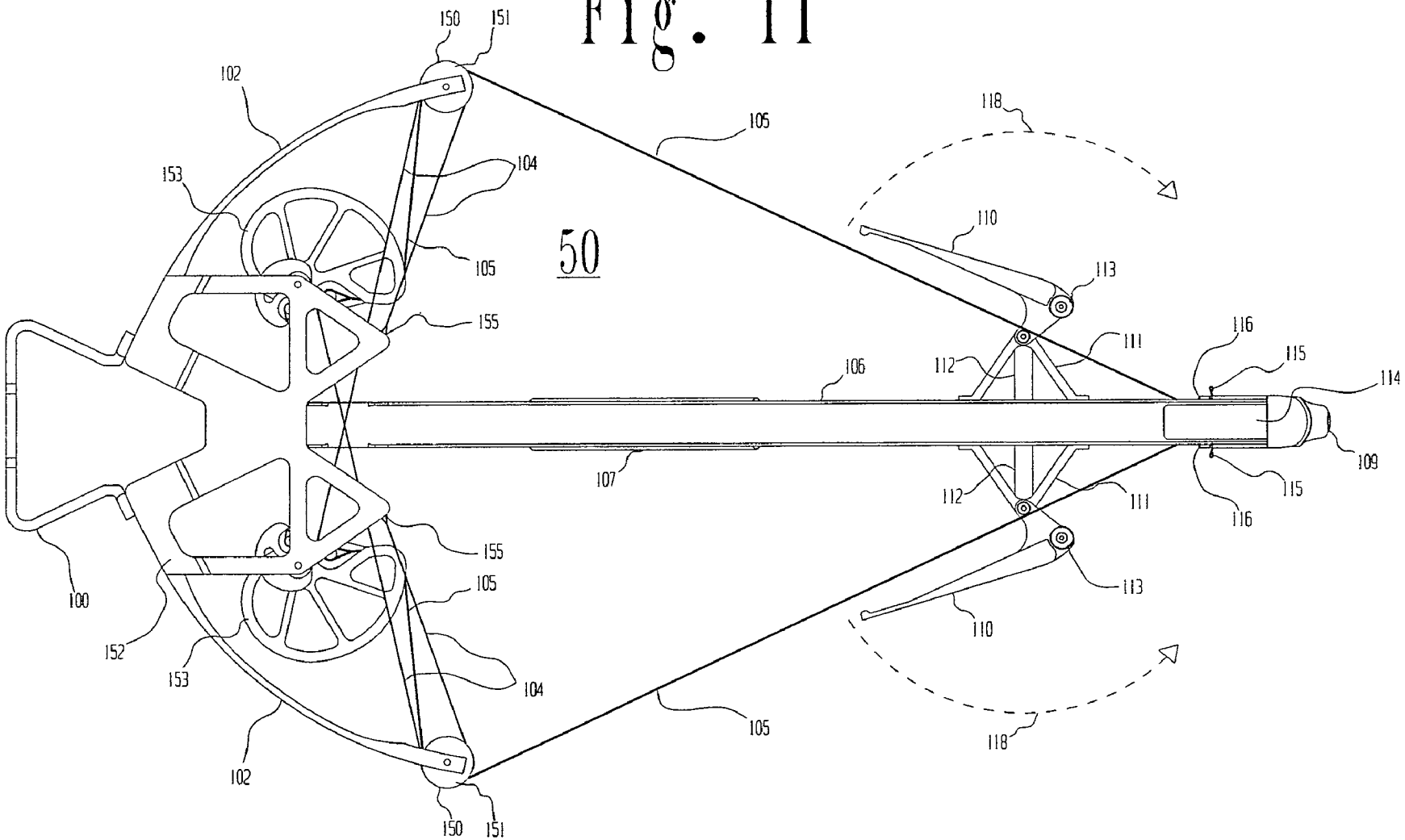
FIG. 11 is a top view of the crossbow in FIG. 9 showing the string in the cocked position and the string compression levers in the open position.
Figure 12:
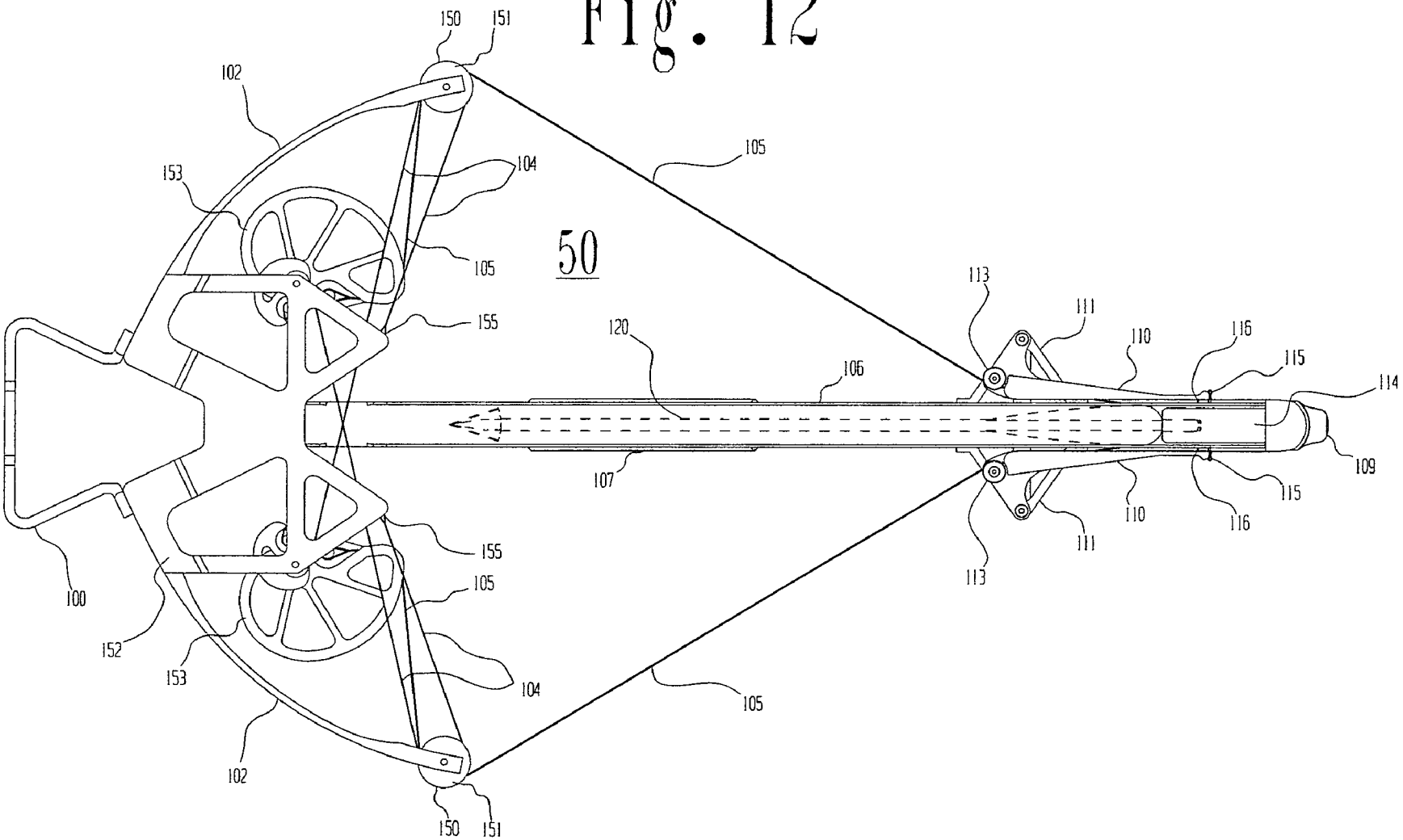
FIG. 12 is a top view of the crossbow in FIG. 9 showing the string in the cocked position and the string compression levers in the closed position.

Referring now to FIGS. 9, 10, 11 and 12, there is illustrated right-side view (FIG. 9) and top views (FIGS. 10, 11 and 12) view of a crossbow 50 with an elongated draw length, right and left eccentric cams 153 mounted between the top and bottom portions of the riser 152, main string idler pulleys 150 and harness idler pulleys 151 with axles attached to the ends of the split limbs 102, and a tubular barrel 106 designed to shoot standard three-fletch arrows 120 with a three-blade hunting tip, illustrative of yet another embodiment of my invention. Components of the crossbow 50 in FIGS. 9, 10, 11 and 12 that are the same as corresponding components of the crossbow 10 in FIG. 1 have been given the same references numbers. When the crossbow 50 is shot, the eccentric cams 153 will extend partially between the openings in split limbs 102 as they rotate. The pulleys 150 and 151 are much smaller than the eccentric cams 153 so that much less mass is loaded on the ends of the split limbs 102. The tips of the limbs 102 of the crossbow 50 move approximately one half the distance that the limbs 102 of crossbow 10 move during shooting which results in the tips of limbs 102 in the crossbow 50 being more efficient because they do not have to accelerate as much mass as the tips of limbs 102 in crossbow 10 of FIG. 1. The main string idler pulleys 150 are on the bottom so that string 105 extends through the slot in the barrel 106. Each harness string 104 (see FIG. 9) starts at a corresponding post machined at a point 155 or otherwise attached to the bottom of the top portion of riser 152 and then goes around the idler pulley 151 on the same side of the barrel 106 and attaches to the harness take-up module of cam 153 on the opposing side of barrel 106. The main string 105 is attached to the string take-up portion of the right cam 153, goes around the right idler pulley 150, extends through the slot in the barrel 106, goes around the left idler pulley 150, and then attaches to the string take-up portion of the left cam 153. FIG. 10 is a top view of the crossbow 50 in FIG. 9 with the string 105 at rest. FIG. 11 is a top view of the crossbow 50 in FIG. 9 showing the string 105 in the cocked position and the string compression levers 110 in the open position. FIG. 12 is a top view of the crossbow in FIG. 9 showing the string 105 in the cocked position and the string compression levers 110 in the closed position.

Thus, a novel crossbow described above and illustrated by the embodiments in the attached drawings has a draw length significantly longer than the draw length of conventional crossbows, thereby providing a longer power stroke with less draw weight that conventional crossbows of substantially the same overall size. If my novel crossbow as described above and illustrated by the embodiments in the attached drawings has the same draw weight as a conventional crossbow, then my novel crossbow will shoot an arrow at a much higher speed than a conventional crossbow with the same draw weight will shoot the same arrow. Furthermore, the novel crossbow is much easier to cock and much safer to operate than prior art crossbows. In addition, the embodiment of crossbow 20 adapted to shoot shot filled sabots may be advantageously utilized for bird hunting, small game hunting or trap shooting, and the embodiment of crossbow 30 adapted to shoot paint-ball filled sabots may be advantageously utilized for paint ball games.

While particular embodiments of my invention have been shown and described, modifications may be made. It is therefore intended in the appended claims to cover all such changes and modifications which fall within the true spirit and scope of my invention.

What is claimed is:

1. A crossbow, comprising:

first and second limbs, each having first and second ends;

a riser to receive the first end of the first and second limbs;

a first cam with an axle to couple to the second end of the first limb;

a second cam with an axle to couple to the second end of the second limb;

a string extending between the first cam and the second cam;

a string release adapted to hold the string when the crossbow is cocked;

a stock having a bore end and a butt end, the stock including a pistol grip, a trigger coupled to the string release, and a barrel extending between the bore end and the butt end of the stock, the bore end of the stock coupled to the riser, the string release disposed near the butt end of the stock, and the barrel adapted to receive one of an arrow or sabot; and first and second levers each coupled to the stock near the butt end and adapted to deflect the string toward the stock when rotated after the crossbow string is cocked and held by the string release.

2. The crossbow according to claim 1, wherein each of the first and second levers has a pulley for engaging the string.

3. The crossbow according to claim 1, wherein each of the first and second levers is L-shaped and has a pulley for engaging the string.

4. The crossbow according to claim 1, wherein the first and second cams are eccentric cams.

5. The crossbow according to claim 1, wherein the barrel has a rectangular cross section for receiving a sabot having a rectangular cross section.

6. The crossbow according to claim 1, wherein the barrel has a circular cross section for receiving a sabot having a circular cross section.

7. The crossbow according to claim 1, wherein the first and second cams are attached to the riser and the crossbow further includes a first pulley with an axle to couple to the second end of the first limb and a second pulley with an axle to couple to the second end of the second limb, and the string extending between the first cam, the first pulley, the second pulley, and the second cam.

8. A crossbow, comprising:

first and second limbs, each having first and second ends;

a riser to receive the first end of the first and second limbs;

a first cam with an axle to couple to the second end of the first limb;

a second cam with an axle to couple to the second end of the second limb;

a string extending between the first cam and the second cam;

a string release adapted to hold the string when the crossbow is cocked;

a stock having a bore end and a butt end, the stock including a pistol grip, a trigger coupled to the string release, and an arrow rest extending between the bore end and the butt end of the stock, the bore end of the stock coupled to the riser, the string release disposed near the butt end of the stock, and the arrow rest adapted to receive an arrow; and first and second levers each coupled to the stock near the butt end and adapted to deflect the string toward the stock when rotated after the crossbow string is cocked and held by the string release.

9. The crossbow according to claim 8, wherein each of the first and second levers has a pulley for engaging the string.

10. The crossbow according to claim 8, wherein each of the first and second levers is L-shaped and has a pulley for engaging the string.

11. The crossbow according to claim 8, wherein the first and second cams are eccentric cams.

12. The crossbow according to claim 8, further including a cover extending from the butt end of the stock for covering a portion of an arrow near the butt end of the stock.

13. The crossbow according to claim 8, wherein the first and second cams are attached to the riser and the crossbow further includes a first pulley with an axle to couple to the second end of the first limb and a second pulley with an axle to couple to the second end of the second limb, and the string extending between the first cam, the first pulley, the second pulley, and the second cam.

14. A crossbow, comprising:

first and second split limbs, each having first and second ends;

a riser to receive the first end of the first and second split limbs;

a first cam with an axle to couple to the riser;

a second cam with an axle to couple to the riser;

a first pulley with an axle to couple to the second end of the first split limb;

a second pulley with an axle to couple to the second end of the second split limb;

a string extending between the first cam, the first pulley, the second pulley, and the second cam;

a string release adapted to hold the string when the crossbow is cocked;

a stock having a bore end and a butt end, the stock including a pistol grip, a trigger coupled to the string release, a shoulder rest disposed at the butt end of the stock, and an arrow rest extending between the bore end and the butt end of the stock, the bore end of the stock coupled to the riser, the string release disposed near the butt end of the stock, and the arrow rest adapted to receive an arrow; and first and second levers each coupled to the stock near the butt end and adapted to deflect the string toward the stock when rotated after the crossbow string is cooked and held by the string release.

15. The crossbow according to claim 14, wherein each of the first and second levers has a pulley for engaging the string.

16. The crossbow according to claim 14, wherein each of the first and second levers is L-shaped and has a pulley for engaging the string.

17. The crossbow according to claim 14, wherein the first and second cams are eccentric cams.

18. The crossbow according to claim 14, further including a third pulley with an axle to couple to the second end of the first split limb, a fourth pulley with an axle to couple to the second end of the second split limb, and a harness string coupled between the riser, the third pulley and the second cam, and another harness string coupled between the riser, the fourth pulley and the first cam.

19. The crossbow according to claim 14, wherein the arrow rest is comprised of a barrel adapted to receive an arrow or sabot.

20. A crossbow, comprising:

first and second limbs, each having first and second ends;

a riser to receive the first end of the first and second limbs;

a first cam with an axle to couple to the second end of the first limb;

a second cam with an axle to couple to the second end of the second limb;

a string extending between the first cam and the second cam;

a string release adapted to hold the string when the crossbow is cocked;

a stock having a bore end and a butt end, the stock including a pistol grip, a trigger coupled to the string release, and an arrow rest extending between the bore end and the butt end of the stock, the bore end of the stock coupled to the riser, the string release disposed near the butt end of the stock, and the arrow rest adapted to receive an arrow; and first and second pulleys each coupled to the stock near the butt end and adapted to deflect the string toward the stock when the crossbow string is cocked and held by the string release.

21. The crossbow according to claim 20, wherein the first and second cams are attached to the riser and the crossbow further includes a third pulley with an axle to couple to the second end of the first limb and a fourth pulley with an axle to couple to the second end of the second limb, and the string extending between the first cam, the first pulley, the second pulley, and the second cam.

22. A crossbow, comprising:

first and second limbs, each having first and second ends;

a riser to receive the first end of the first and second limbs;

a first cam with an axle to couple to the second end of the first limb;

a second cam with an axle to couple to the second end of the second limb;

a string extending between the first cam and the second cam;

a string release adapted to hold the string when the crossbow is cocked;

a stock having a bore end and a butt end, the stock including a pistol grip, a trigger coupled to the string release, and an arrow rest extending between the bore end and the butt end of the stock, the bore end of the stock coupled to the riser, the string release disposed near the butt end of the stock, and the arrow rest adapted to receive an arrow; and means coupled to the stock near the butt end for deflecting the string toward the stock when the crossbow string is cocked and held by the string release.

23. A crossbow, comprising:

first and second limbs, each having first and second ends;

a riser to receive the first end of the first and second limbs;

a first cam with an axle to couple to the riser, a second cam with an axle to couple to the riser;

a first pulley with an axle to couple to the second end of the first limb;

a second pulley with an axle to couple to the second end of the second limb;

a string extending between the first cam, the first pulley, the second pulley, and the second cam;

a string release adapted to hold the string when the crossbow is cocked; a stock having a bore end and a butt end, the stock including a pistol grip, a trigger coupled to the string release, and an arrow rest extending between the bore end and the butt end of the stock, the bore end of the stock coupled to the riser, the string release disposed near the butt end of the stock, and the arrow rest adapted to receive an arrow; and means coupled to the stock near the butt end for deflecting the string toward the stock when the crossbow string is cocked and held by the string release.

* * * * *